US006743859B2

(12) United States Patent
Kowaka et al.

(10) Patent No.: US 6,743,859 B2
(45) Date of Patent: Jun. 1, 2004

(54) POLYVINYL ALCOHOL POLYMER PRODUCTION METHOD AND POLYVINYL ALCOHOL POLYMER

(75) Inventors: Tsuyoshi Kowaka, Kurashiki-machi (JP); Junji Funakoshi, Kurashiki (JP); Hiroyuki Miyawaki, Kurashiki (JP); Kazunori Watanabe, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 09/577,158

(22) Filed: May 24, 2000

(65) Prior Publication Data

US 2003/0004279 A1 Jan. 2, 2003

(30) Foreign Application Priority Data

Jun. 9, 1999 (JP) ..... 11-161757

(51) Int. Cl.[7] ..... C08F 8/12; C08G 63/91
(52) U.S. Cl. ..... 525/62
(58) Field of Search ..... 525/62

(56) References Cited

U.S. PATENT DOCUMENTS

| | | | | | |
|---|---|---|---|---|---|
| 3,080,350 | A | * | 3/1963 | Imai et al. | 525/62 |
| 3,684,768 | A | * | 8/1972 | King et al. | 528/302 |
| 4,110,494 | A | * | 8/1978 | Schindler et al. | 427/385.5 |
| 5,187,226 | A | * | 2/1993 | Kamachi et al. | 525/62 |
| 5,352,750 | A | * | 10/1994 | Yanai et al. | 526/225 |
| 5,418,269 | A | * | 5/1995 | Ishiwa et al. | 524/315 |
| 5,710,211 | A | * | 1/1998 | Sato et al. | 525/62 |

FOREIGN PATENT DOCUMENTS

| | | |
|---|---|---|
| EP | 0 661 392 | 7/1995 |
| GB | 563960 | 9/1944 |
| JP | 3-40807 | 2/1991 |

OTHER PUBLICATIONS

Standiford, "Evaporization", Kirk–Othmer Encyclopedia of Chemical Technology, 4th ed., vol. 8, John Wiley & Sons, New York pp 959–961, 965–981 (1996).*

PTO English Translation of JP–03–040807, PTO 02–0825, Dec. 2001.*

Standiford, "Evaporation", Kirk–Othmer Encyclopedia of Chemical Technology, 4$^{th}$ ed., John WileY & Sons, New York (1994).*

Abstract of JP–03–40804, Acc. No. 1991–097567, Deerwent Information Ltd., (1991).*

Morrison et al., Organic Chemistry, 3rd ed., Allyn and Bacon, Inc., Boston, pp 682–683 (1973).*

Patent Abstracts of Japan, vol. 015, No. 73 (C–0828), May 2, 1991, JP 03 040808, Feb. 21, 1991.

* cited by examiner

*Primary Examiner*—D. R. Wilson
(74) *Attorney, Agent, or Firm*—Oblon, Spivak, McClelland, Maier & Neustadt, P.C.

(57) ABSTRACT

A method of producing polyvinyl alcohol polymer, with which a high-strength polyvinyl alcohol polymer with a high degree of saponification can be obtained, the polyvinyl ester saponification process can be linked directly with the spinning process, in which the polyvinyl alcohol polymer is made into fiber, the mole ratio of alcohol with respect to the polyvinyl alcohol can be freely selected, and the concentration of the polyvinyl alcohol obtained by the saponification reaction is high. The polyvinyl alcohol polymer that is obtained by this method exhibits a high block character value and is excellent in randomness is provided, wherein a polyvinyl ester is subject to a saponification reaction in an alcohol-containing organic solvent under the presence of a saponification catalyst and the saponification is carried out while distilling off the carboxylic acid ester that is produced by the saponification reaction.

5 Claims, 2 Drawing Sheets

POLYVINYL ALCOHOL POLYMER PRODUCTION METHOD AND POLYVINYL ALCOHOL POLYMER

BACKGROUND OF THE INVENTION

1. Field of the Invention

This invention concerns a polyvinyl alcohol polymer production method and a polyvinyl alcohol polymer (hereinafter, polyvinyl alcohol shall be abbreviated as "PVA"). To be more specific, this invention concerns, along with PVA, a method of producing PVA polymer by saponifying a polyvinyl ester in an alcohol-containing organic solvent under the presence of a saponification catalyst and with which the saponification reaction is carried out while distilling off the carboxylic acid ester that is produced by the saponification reaction.

2. Description of the Prior Art

For producing PVA, the method in which vinyl acetate is obtained by acetoxylation of ethylene, polymerizing this vinyl acetate to obtain polyvinyl acetate, and saponifying this polyvinyl acetate under the presence of a basic catalyst is used generally and practiced industrially as well. As methods of saponification, methods that use various types of saponifiers, such as the belt type, pipe type, slurry type, etc., are known, and the PVA that is obtained by saponification by such methods is made into powder, dried, and then used in various applications. In industrial material applications and composite material reinforcement applications, an aqueous solution of PVA, obtained by dissolving powder-form PVA in water, is used as the spinning stock solution, and spinning is performed by a wet, dry-wet, or other type of spinning method to use the PVA in the form of PVA fiber. However, when the content of sodium acetate in the PVA is high, the fiber obtained by making the PVA into fiber may at times be colored. Moreover, acid is required for adjusting the degree of saponification of PVA, and the equipment tends to be large in scale.

In recent years, methods of spinning PVA in an organic solvent to produce high-strength PVA fibers more suitable for industrial material and composite material reinforcement applications are being examined. For example, Japanese Laid-open Patent Publication No. 40807/1991 discloses a method of producing PVA fiber by spinning a PVA solution obtained by saponifying a polyvinyl ester having a high degree of polymerization in an organic solvent. With this method, the organic solvent used for the polyvinyl ester saponification process may be used in common as the organic solvent used in the spinning process in which the PVA polymer solution is spun, and a rational PVA fiber production process in which the saponification process and the spinning process are linked directly can be constructed.

However, in order to raise the degree of saponification of PVA in cases where alcohol is used to saponify the polyvinyl ester, the mole ratio of methanol with respect to PVA must be made high. However, if the mole ratio of methanol with respect to PVA for increasing the degree of saponification of PVA is made too high, the PVA gels, and since a large amount of organic solvent, such as dimethyl sulfoxide (DMSO), must thus be used to prevent gelling, the concentration of the PVA that was obtained was only a few % at the most. With the present invention, in the case where only polyvinyl ester exists, the mole ratio of alcohol with respect to PVA shall refer to the mole ratio with respect to the amount of PVA as determined based on conversion of all of the polyvinyl ester to PVA, and in the case where PVA and polyvinyl ester coexist, the mole ratio of alcohol with respect to PVA shall refer to the mole ratio with respect to the amount of the PVA that already exists and the amount of PVA as determined based on conversion of all of the polyvinyl ester to PVA. This mole ratio shall hereinafter be referred to simply as the mole ratio of alcohol. Also with this invention, the concentration of PVA polymer in the saponification reaction solution shall refer to the concentration of the PVA generated by the saponification reaction plus the PVA as determined based on conversion of the unreacted polyvinyl ester to PVA in the organic solvent from which alcohol has been excluded.

If a high-strength PVA polymer with a higher degree of saponification than those of prior arts can be obtained, this will be beneficial industrially and if the organic solvent used in the polyvinyl ester saponification process can be used in common as the organic solvent used in the spinning process in which the PVA polymer solution is spun and the PVA concentration can be increased further, the saponification process for the PVA polymer and the spinning process for making the PVA polymer into fiber can be linked directly to make the PVA fiber production process a rational process with higher productivity. Also, if a PVA polymer production method can be established with which the mole ratio of alcohol can be selected freely and the degree of saponification of PVA polymer and the concentration of PVA polymer can be adjusted freely, it will become possible to produce PVA polymers suited for various needs.

Thus a first object of this invention is to provide a method of producing PVA polymer, with which a PVA polymer, which has a higher degree of saponification than those of the prior arts and can be used as raw material for high-strength fibers, may be obtained at a low mole ratio of alcohol.

A second object of this invention is to provide a rational method of producing PVA polymer, which does not require the processes of drying, pulverizing, and dissolving the PVA in organic solvent, with which the saponification process for the PVA polymer can be directly linked to the spinning process for making the PVA into fiber, and with which the concentration of PVA polymer will be high and the content of sodium carboxylate in the PVA polymer will be low.

A third object of this invention is to provide a method of producing PVA polymer, with which the mole ratio of alcohol with respect to polyvinyl carboxylate can be freely selected and the degree of saponification of PVA polymer and the concentration of PVA polymer can be freely adjusted.

A fourth object of this invention is to provide a method of producing PVA polymer fiber in which the polyvinyl ester saponification process is directly linked with the spinning process in which the PVA polymer solution, obtained by the saponification process, is spun.

A fifth object of this invention is to provide a PVA polymer, which has a block character value of 0.9 to 1.1 and is high in randomness.

SUMMARY OF THE INVENTION

However, as has been mentioned above, the operation for increasing the degree of saponification of PVA conflicts with the operation for raising the concentration of PVA. In order to establish a method of producing PVA polymer that meets the above objects, the present inventors have repeatedly examined the polyvinyl ester saponification reaction in detail and have come to make the present invention. That is, the present invention provides in a method of producing polyvinyl alcohol polymer, in which a polyvinyl ester is saponified in an alcohol-containing solvent under the presence of a saponification catalyst, a method of producing polyvinyl alcohol polymer characterized in that the saponification reaction is carried out while distilling off the carboxylic acid ester that is produced by the saponification reaction.

This invention also provides a method of producing PVA polymer fiber in which the polyvinyl ester saponification process is directly linked with the spinning process in which the PVA polymer solution, obtained by the saponification process, is spun.

This invention furthermore provides a PVA polymer, which has a block character value of 0.9 to 1.1 and is high in randomness.

By this invention, a high-strength PVA polymer, which is excellent in randomness and has a higher degree of saponification than PVA polymers of the prior art, can be obtained. Also with this invention, since the rate of saponification of polyvinyl ester is fast and a PVA polymer can be obtained at high concentration in an organic solvent, the polyvinyl ester saponification process can be directly linked with the spinning process, in which the PVA polymer solution is made into fiber, and since the mole ratio of alcohol can be selected freely and the degree of saponification of the PVA polymer that is obtained can be adjusted freely, a rational PVA fiber production process can be constructed.

BRIEF DESCRIPTION OF THE DRAWINGS

The foregoing and other features and advantages of the present invention will become more readily more appreciated as the same becomes better understood by reference to the following detailed description when taken into conjunction with the accompanying drawings wherein.

DESCRIPTION OF THE PREFERRED EMBODIMENTS

Figure 1:
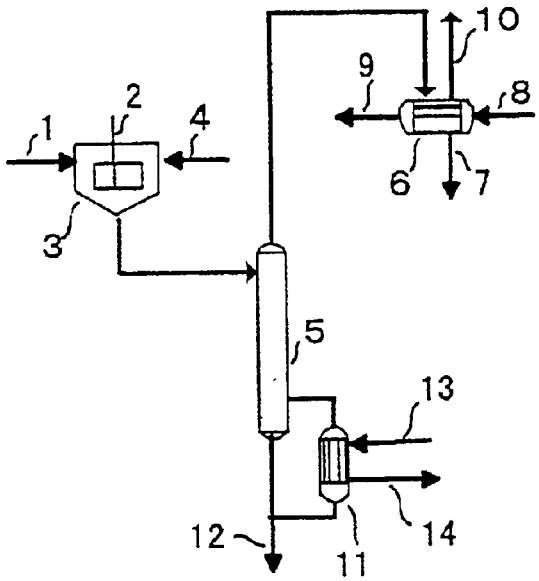
FIG. 1 is an example of the flow of production of a PVA polymer by a one-stage saponification reaction.

With the production method of PVA polymer of this invention, the polyvinyl ester saponification reaction is carried out in an alcohol-containing organic solvent under the presence of a saponification catalyst and is carried out while distilling off the carboxylic acid ester that is produced by the saponification reaction. With this method, a PVA polymer of a high degree of saponification can be obtained at alcohol mole ratios lower than that of prior arts, and the concentration of the PVA polymer obtained will also be high. Though the conditions of the saponification reaction will differ according to the type of organic solvent used, it is normally carried out at a reaction pressure of approximately 5 kg/cm$^2$ G to 20 Torr and a reaction temperature of approximately 60 to 110° C. With the method of this invention, since the rate of the saponification reaction may be made 1000 times or more fast than that attained in prior methods, the reaction can be carried out with the residence time in the saponification reactor being set to 10 minutes or less and the reaction device can thus also be made compact.

The abovementioned saponification reaction is preferably carried out as a saponification reaction comprised of a primary reaction, in which a polyvinyl ester is mixed in an alcohol-containing organic solvent under the presence of a saponification catalyst to carry out the saponification reaction, and a secondary reaction, in which the saponification reaction is carried out while distilling off the carboxylic acid ester that is produced. The degree of saponification of PVA can then be increased and the reaction can be carried out in a stable manner. The degree of saponification in the primary saponification reaction can be controlled by adjusting the mole ratio of alcohol with respect to PVA and the degree of saponification in the secondary saponification reaction can be controlled by adjusting the rate at which the alcohol and carboxylic acid ester are distilled off. It is preferable for the saponification reaction to be comprised of the abovementioned primary and secondary saponification reactions from this aspect of control of the saponification reaction as well.

In order to raise the final degree of saponification attained, it is preferable in the abovementioned primary saponification reaction for the degree of saponification attained to be 70 mole % or more and the concentration of PVA polymer in the saponification reaction solution to be 10 wt % or more, and it is even more preferable for the degree of saponification attained to be 80 to 93 mole % and the concentration of PVA polymer in the saponification reaction solution to be 15 wt % or more.

Also from the above standpoint, it is preferable in the abovementioned secondary saponification reaction for the degree of saponification attained to be 85 mole % or more and the concentration of PVA polymer in the saponification reaction solution to be 10 wt % or more, and it is even more preferable for the equilibrium degree of saponification attained to be 88 to 98 mole % and the concentration of PVA polymer in the saponification reaction solution to be 15 wt % or more.

The abovementioned saponification reaction is preferably comprised of a first stage saponification process, comprised in turn of a primary saponification reaction, in which a saponification reaction is carried out by mixing the polyvinyl ester in the alcohol-containing organic solvent under the presence of a saponification catalyst, and a subsequent secondary saponification reaction, in which a saponification reaction is carried out while distilling off the carboxylic ester that is produced, and a subsequent second stage saponification process, comprised in turn of a primary saponification reaction, in which a saponification reaction is carried out by mixing the polyvinyl ester in the alcohol-containing organic solvent under the presence of a saponification catalyst, and a subsequent secondary saponification reaction, in which a saponification reaction is carried out while distilling off the carboxylic ester that is produced. The degree of saponification of the PVA polymer can then be made even higher.

In the primary saponification reaction in the first stage saponification process, it is preferable for the degree of saponification attained to be 70 mole % or more and the concentration of PVA polymer in the saponification reaction solution to be 10 wt % or more, and it is even more preferable for the degree of saponification attained to be 80 to 93 mole % and the concentration of PVA polymer in the saponification reaction solution to be 15 wt % or more. Also in the secondary saponification reaction in the first stage saponification process, it is preferable for the degree of saponification attained to be 85 mole % or more and the concentration of PVA polymer in the saponification reaction solution to be 10 wt % or more, and it is even more preferable for the degree of saponification attained to be 88 to 98 mole % and the concentration of PVA polymer in the saponification reaction solution to be 15 wt % or more.

In the primary saponification reaction in the second stage saponification process, it is preferable for the degree of saponification attained to be 93 mole % or more and the concentration of PVA polymer in the saponification reaction solution to be 10 wt % or more, and it is even more preferable for the degree of saponification attained to be 97 to 99.5 mole % and the concentration of PVA polymer in the saponification reaction solution to be 15 wt % or more. Also in the secondary saponification reaction in the second stage saponification process, it is preferable for the degree of saponification attained to be 99 mole % or more and the concentration of PVA polymer in the saponification reaction solution to be 10 wt % or more, and it is even more preferable for the degree of saponification attained to be 99.6 to 99.9 mole % and the concentration of PVA polymer in the saponification reaction solution to be 15 wt % or more.

In the abovementioned first stage and second stage saponification processes, it is important for the saponification reactor, in which the primary saponification reaction is carried out, to mix the saponification reaction stock solution (paste), comprised of polyvinyl carboxylate, alcohol, and organic solvent, and the saponification catalyst in a short time without fail. From this standpoint, a reactor that is substantially of the complete mixing type is preferably used. A complete mixing type reactor refers to a device that is one ideal limiting condition of the flow that passes through a flow system device, that is, a flow in which the fluid that flows into the device will be uniformly dispersed within the device immediately after flowing in. In this condition, the values of physical properties, such as concentration, temperature, etc., at each moment are completely uniform and the values exhibited by the outflowing fluid are equal to the values in the device at that time.

Examples of reactors that are close to being such a complete mixing type reactor include line mixers and various other mixers of high mixing efficiency and mixers equipped with various types of stirring blades. Among such mixers, the use of a kneader type mixer is preferable. The mixer made under the trade name of S1 Mixer (Type SMJ40) by Sakura Plant Co., Ltd. can be given as an example.

A reactor that is substantially of the piston-flow type is preferably used as the saponification reactor for carrying out the saponification reaction while distilling off the abovementioned carboxylic acid ester. A piston-flow type reactor refers to a reactor with which the fluid that flows into the reactor continues to undergo motion integrally and without becoming mixed with other fluid portions after flowing in.

Though tube type reactors, reactors in which a plurality of mixing tanks are connected in series, etc. can be given as examples of such a reactor, a tower type reactor is preferably used in this invention. Examples of tower type reactors include packed towers, perforated plate towers, and plate towers, such as bubble-cap towers. It is generally practical and thus preferable to use a packed tower or a plate tower. Also with this invention, a heat-exchanging type reactor may be used favorably, and examples of this type of reactor include falling film evaporators, such as plate-fin type evaporators, wetted-wall towers, etc., thin film evaporators, and shell and tube evaporators.

If the above-described two-stage saponification, comprised of first and second stage saponification processes, is to be employed, a wetted-wall tower or tray tower is preferably used for the secondary saponification reaction of the first stage, and a shell and tube evaporator or plate fin type evaporator, etc. is preferably used in the secondary saponification reaction of the second stage in that the flow conditions of the PVA polymer solution, obtained by the primary saponification reaction, can then be kept uniform, the heat transfer efficiency will be excellent, and methyl acetate can be distilled off readily. Especially in the case where an organic solvent of high boiling point is to be used, the abovementioned saponification process of the second stage is preferably carried out under highly depressurized conditions, and in order to avoid temperature drops due to sudden flashing, it is preferable to use a shell and tube evaporator, with which the reaction solution obtained by the primary saponification reaction is supplied in an up-flowing manner.

A polyvinyl ester of a high degree of polymerization and having a limiting viscosity of 1.4 dl/g or more and preferably 3.2 dl/g or more is preferable as the polyvinyl ester to be used in this invention since a PVA fiber of high strength can then be obtained. Though such a polyvinyl ester can be produced by a known polymerization method, such as the bulk polymerization method, solution polymerization method, suspension polymerization method, etc., a solution polymerization method is preferably employed from the standpoint of industrial practice. In this invention, limiting viscosity refers to the viscosity as measured by a BH viscometer at 30° C.

Though examples of the polyvinyl ester include polymers obtained by polymerization of vinyl carboxylates, such as vinyl formate, vinyl acetate, vinyl propionate, vinyl valerate, vinyl caprinate, vinyl laurate, vinyl stearate, etc., and vinyl carboxylate copolymers, such as ethylene-vinyl acetate copolymer, etc., polyvinyl acetate is preferable in that the invention can be put to practice in an industrially advantageous manner.

Besides the abovementioned polymers, the polyvinyl ester in this invention may, within a range that will not inhibit the effects of this invention, be a copolymer obtained by copolymerization with another monomer. Examples of such a monomer include unsaturated carboxylic acids, such as (meth)acrylic acid, crotonic acid, itaconic acid, maleic anhydride, etc., mono- and dialkyl esters, nitriles, such as (meth)acrylonitrile, etc., amides, such as (meth)acrylamide, etc., olefin sulfonic acids and their salts, such as ethylene sulfonic acid, (meth)aryl sulfonic acid, etc., alkyl vinyl ethers, polyoxyalkyl aryl ethers, alkyl ethers, saturated carboxylic acids, aryl esters, vinyl ketone, N-methylpyrrolidone, vinylidene chloride, vinylidene fluoride, unsaturated vinyl monomers that contain an oxyalkylene group, vinylalkoxysilane, etc.

The organic solvent used in this invention may be any organic solvent that can dissolve the polyvinyl ester and can also dissolve the PVA polymer that is produced after saponification. Examples include non-protonic polar solvents, non-protonic nonpolar solvents, and lower diamine and triamine compounds. Non-protonic polar solvents are polar solvents that do not have a protonic hydrogen, and examples include DMSO, dimethylformamide, dimethylacetamide, N-methylpyrrolidone, tetrahydrofuran, dimethyltetrahydrofuran, dioxane, acetone, methyl ethyl ketone, acetonitrile, toluene, chlorobenzene, etc. Non-protonic nonpolar solvents are nonpolar solvents that do not have a protonic hydrogen, and examples include benzene, toluene, etc.

Examples of lower diamine and triamine compounds include ethylenediamine, diethylenediamine, etc. An organic solvent, with which the solution becomes more uniform and transparent after distilling off the non-solvent components after the completion of saponification, may also be used. Among the above, DMSO, dimethylformamide, dimethylacetamide, N-methylpyrrolidone, ethylenediamine, and diethylenetriamine are preferable organic solvents in that not only can a PVA polymer be obtained in a uniform system from the beginning to the end but also in that these solvents do not require operations for dissolution of the PVA polymer. The use of DMSO is especially preferable in that the PVA polymer that is obtained will be extremely high in stability in a low-temperature aqueous solution.

Alcohol is necessary for the polyvinyl ester saponification reaction, and alcohols and glycols, such as methanol, ethanol, propanol, ethylene glycol, propylene glycol, glycerin, diethylene glycol, etc., may be used as the alcohol upon mixing with an abovementioned organic solvent. Water, acetic acid, methyl acetate, etc. may also be mixed with the organic solvent containing such an alcohol. The use of methanol as the alcohol is preferable in that methanol is readily obtained, inexpensive, has a low boiling point, and is easy to handle.

The saponification catalyst must be soluble in the organic solvent, and examples include alkali metal hydroxides, alkali metal alkoxides, alkali metal carbonates, alkali metal bicarbonates, etc. Examples of alkali metal hydroxides include, sodium hydroxide, potassium hydroxide, lithium hydroxide, and examples of alkali metal alkoxides include sodium methoxide, sodium ethylate, etc. Examples of alkali metal carbonates include sodium carbonate, calcium carbonate, etc., and examples of alkali metal bicarbonates include sodium bicarbonate, potassium bicarbonate, etc.

In the case where DMSO is used as the organic solvent, the use of sodium methoxide is preferable from the point of solubility. Since the effect of adding the saponification catalyst will be small if the amount of catalyst added is too low while the PVA polymer will become colored if the amount added is too high, the saponification catalyst is added at a molar ratio of 0.0005 to 0.05 with respect to the total vinyl ester units in the polyvinyl ester. This ratio is preferably set to 0.001 to 0.005 if the abovementioned sodium methoxide is to be used. If coloration of the PVA polymer or lowering of the degree of polymerization occurs during the saponification reaction, adequate deoxygenation should be performed and a deoxydizing agent, such as hydroquinone, should be added.

The greatest feature of this invention is that the polyvinyl ester is mixed in an alcohol-containing organic solvent under the presence of the saponification catalyst and the saponification reaction is carried out while distilling off the acetic acid ester that is produced. Though the molar ratio of alcohol is not restricted in this invention, the molar ratio of alcohol is preferably set to 0.5 to 5.5 from the standpoint of preventing the coloration of the PVA polymer that is obtained and recovering the alcohol in a thermally advantageous manner, and from the standpoint of preventing the gelling of the PVA polymer and recovering the alcohol in a thermally advantageous manner, the molar ratio of alcohol is preferably set to 1.0 to 3.0.

The degree of saponification attained can be calculated by analyzing the residual carboxylic acid group by alkalimetry such as sodium hydroxide, etc. The time required to reach equilibrium is relatively short, and is usually within a few minutes. The PVA polymer solution obtained upon saponification may be used as it is, as a spinning stock solution, and the PVA polymer can be spun and made into fiber by a wet method, dry-wet method, or other known spinning method. Also, according to the desired application, the PVA polymer may be extruded through a die and used upon being made into a film.

FIG. 1 shows the flow for the production of a PVA polymer by a one-stage saponification reaction using a kneader type mixer and a tower type reactor. An example where polyvinyl acetate is saponified by methanol shall be explained in detail with FIG. 1. To the mixer 3, equipped with a stirrer 2, a paste, comprised essentially of polyvinyl acetate, methanol, and DMSO, is supplied from paste feeding line 1 and, at the same time, sodium methoxide, which is the saponification catalyst, is supplied from catalyst feeding line 4 to carry out the primary saponification reaction. The primary saponification reaction is carried out under a pressure of atmospheric pressure to approximately 5 $kg/cm^2G$ and a temperature of approximately 60 to 110° C. The composition of the paste is normally set so that methanol/PVA=0.5 to 5.5 (mole ratio) and DMSO/polyvinyl acetate=7 to 18.5 (weight ratio).

The mixed liquid obtained by the primary saponification reaction is fed to the tower top of a packed tower 5, filled with stainless-steel Raschig rings, etc., the secondary saponification reaction is carried out using the heat supplied from reboiler 11, and a portion of the methyl acetate that is produced and a portion of the unreacted methanol is distilled off from the tower top. The mixture of methyl acetate and methanol that have been distilled off is cooled by a condenser 6 and recovered via methyl acetate/methanol recovery line 7. 8 is the entrance for the coolant and 9 is the exit for the coolant. The packed tower 5 for carrying out the secondary saponification is preferably depressurized to approximately 20 Torr and operated at a temperature of approximately 60 to 110° C. 10 is the vacuum line. 13 is the entrance for the heating medium of reboiler 11 and 14 is the exit for the heating medium. The reaction solution obtained by the secondary saponification reaction is taken out via saponification reaction solution recovery line 12 and sent to the spinning process.

Figure 2:
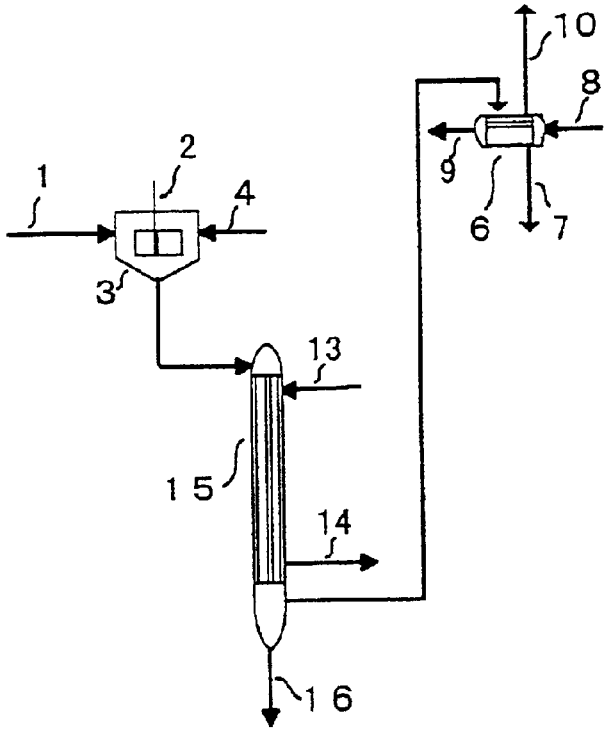
FIG. 2 is another example of the flow of production of a PVA polymer by a one-stage saponification reaction.

FIG. 2 shows the flow for producing a PVA polymer using a falling film evaporator for the secondary saponification reaction. As with the case illustrated in FIG. 1, the primary saponification reaction is carried out in the mixer and the abovementioned primary saponification reaction solution is supplied to the top part of a preheated falling film evaporator 15 to carry out the secondary saponification reaction. 13 is the entrance for the heating medium and 14 is the exit for the heating medium. This reaction solution flows down along the evaporator while forming a thin film and the secondary saponification reaction is carried out. In the same manner as described above, a portion of the methyl acetate that is produced and a portion of the unreacted methanol are passed through a condenser and recovered via methyl acetate/methanol recovery line 7. The PVA polymer solution is taken out via saponification reaction solution recovery line 16 and sent to the spinning process. As with the above-described case, the falling film evaporator 15 is preferably depressurized and operated at a temperature of 60 to 110° C.

Figure 3:
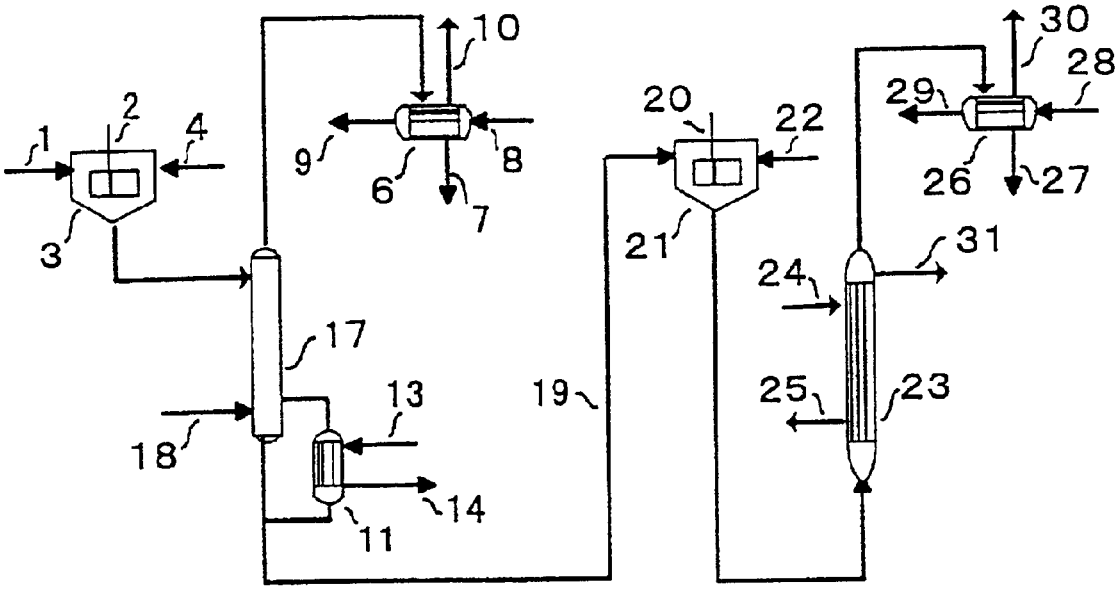
FIG. 3 is an example of the flow of production of a PVA polymer by a two-stage saponification reaction.

FIG. 3 shows the flow for producing a PVA polymer by a two-stage saponification reaction, comprised of a first stage saponification process, which makes use of a kneader type mixer and a tower type reactor, and a second stage saponification process, which is comprised of a kneader type mixer and a heat-exchanging type reactor. In the first stage saponification process, a tray tower 17 is used as the tower type reactor, and in the second stage saponification process, a shell and tube evaporator 23 is used as the heat-exchanging type reactor. Though the primary saponification reaction and secondary saponification reaction of the first stage may be carried out in the same manner as described with reference to FIG. 1 or FIG. 2, in the case where a PVA polymer is to be produced by a two-stage saponification reaction, methanol vapor is preferably blown in from the alcohol vapor feeding line 18 at the lower part of the tower to distill out the methyl acetate as much as possible and improve the degree of saponification further. The lower part of the tower refers to the tower bottom or a portion about ⅓ of the way up from the bottom. The primary saponification reaction of the second stage is carried out under a pressure of atmospheric pressure to 5 kg/cm$^2$ G and a temperature of approximately 60 to 110° C. The items with symbols 20 to 22 are substantially the same as the items with symbols 2 to 4 described above.

The secondary saponification reaction of the second stage is carried out under a pressure of atmospheric pressure to 20 Torr and a temperature of approximately 60 to 110° C. As has been mentioned above, for the secondary saponification reaction of the second stage, in order to avoid temperature drops due to sudden flashing by depressurization, it is preferable to employ a shell and tube evaporator 23, which supplies the reaction solution obtained by the primary saponification reaction in an up-flowing manner. 24 is the entrance for the heating medium, 25 is the exit for the heating medium, and 30 is the vacuum line. The secondary saponification reaction solution is recovered via secondary saponification reaction solution recovery line 31 and sent to the spinning process. The items with symbols 26 to 29 are substantially the same as the items with symbols 6 to 9 described above. In the spinning process, the secondary saponification reaction solution is extruded from a nozzle into a coagulation bath, comprised of methanol and DMSO for example, and made into fiber.

Though a normally used spinning method, such as the wet, dry, and wet-dry methods, etc., may be employed as the spinning method, a wet method is preferred. Alcohols, such as methanol, ethanol, butanol, etc., solvents, such as acetone, benzene, toluene, dimethylformamide, dimethylacetamide, DMSO, etc., and mixed solvents of the above may be used as the coagulant, and coagulation is carried out under a coagulation temperature of −20 to 0° C. The removal of solvent from the spun fiber is generally carried out by extraction by a chemical and/or drying. The fiber may be drawn inside an aqueous or organic solvent bath before complete elimination of the solvent or after the solvent has been eliminated. Drawing is carried out by dry heat at a temperature of 200° C. or more at least at the final stage, and the total draw ratio is preferably set to 15 times or more. If the final drawing temperature is less than 200° C., the movement of the molecular chains necessary for drawing will be inadequate and a high draw ratio cannot be achieved, and since the crystallinity will drop, the fixing of the molecular chains will be inadequate and a high-strength fiber will be difficult to obtain.

The drawing temperature is preferably set to 225 to 235° C. At a drawing temperature of 245° C. or more, the molecular chains will slip by each other and the draw ratio will tend to be low and colored decomposition may occur to cause lowered strength. Though the drawing may be carried out without any problem in an oil bath of 200° C. or more, a process for removing the oil that has become attached to the fiber will be necessary in this case. Dry heat drawing may be carried out in a single stage or in multiple stages of two or more stages under an atmosphere of air or inert gas, and the use of a non-contacting type hollow heater is preferable from the point of fiber damage.

The PVA polymer of this invention has a block character value of 0.9 to 1.1. With this invention, the block character refers to the value defined as $\eta$=[OH—OAC]/{2[OH][OAc]} for the PVA indicated by formula (I) given below and is an index of the randomness of the PVA polymer. Here, [OH] is the mole percentage of the hydroxyl groups of the vinyl alcohol, [OAc] is the mole percentage of the acetyl groups of the vinyl acetate units, and [OH—OAc] is the mole percentage of the OH—OAc group chains in PVA unit (I). The block character can be determined by measuring the methylene carbons in the PVA polymer using $^{13}$C-NMR. As has been mentioned above, the PVA of this invention has a high $\eta$ value in comparison to prior art PVA's ($\eta \leqq 0.5$), is high in randomness, and exhibits the following characteristics.

(1) The viscosity of an aqueous solution of the PVA polymer of this invention is low in comparison to that of PVA saponified by methanol in the range of low degree of saponification.

(2) The PVA of this invention is low in the amount of foaming and is less likely to foam in comparison to PVA's saponified using methanol.

(3) The PVA of this invention is low in crystallinity (melting point) and high in water solubility.

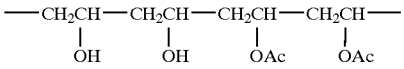

(PVA unit/Formula (I))

This invention shall now be described more specifically by way of examples. However, this invention is by no means limited by these examples.

EXAMPLES

Example 1

Polyvinyl acetate with a limiting viscosity of 1.4 dl/g was dissolved in DMSO and methanol to prepare a paste with a DMSO/polyvinyl acetate ratio of 70/30 (weight ratio) and a methanol mole ratio of 3. Sodium methoxide was added at a mole ratio of 0.002 with respect to the vinyl acetate units, and the mixture was loaded into a kneader type mixer (S1 Mixer Type SMJ40, made by Sakura Plant Co., Ltd.) under a pressure of 4.0 kg/cm$^2$ G and a temperature of 100° C. to carry out the primary saponification reaction. Upon analyzing the residual acetate groups in the reaction solution by alkalimetry, the degree of saponification was determined to be 93 mole %.

The reaction solution obtained by the primary saponification reaction was then supplied to the tower top of a packed tower filled with Raschig rings and the secondary saponification reaction was carried out under a pressure of 550 Torr and a reaction temperature of 100° C. while distilling off the methyl acetate that was produced and the unreacted methanol. The final degree of saponification attained was 97 mole % and the average degree of polymerization of the PVA that was obtained was 1720. The reaction solution obtained by the saponification reaction was a solution with a PVA concentration of 19.5 wt % and this solution could be used as it is as a spinning stock solution in a spinning process to produce fiber. The block character value of the PVA was 0.99.

Example 2

The PVA polymer solution obtained by the primary saponification reaction of the first example was supplied to the top of a plate fin type evaporator (Hibiscus, made by Mitsui Shipbuilding Co., Ltd.) and the secondary saponification reaction was carried out under a pressure of 50 Torr, a temperature of 98° C., while distilling the methyl acetate produced and the unreacted methanol out of the system. The final degree of saponification attained was 97.5 mole % and the average degree of polymerization of the PVA that was obtained was 1720. The reaction solution obtained by the saponification reaction was a solution with a PVA concentration of 19.5 wt % and this solution could be used as it is as a spinning stock solution in a spinning process to produce fiber. The block character value of the PVA was 0.99.

Example 3

Deeming the saponification reaction solution obtained in Example 1 to be the first stage saponification reaction solution, this reaction solution was used as the second stage saponification stock solution to carry out the saponification reaction in two stages. For the primary saponification reaction of the second stage, the same kneader type mixer as that used for the first example was used and the saponification reaction was carried out under a pressure of 4.0 $kg/cm^2G$ and a temperature of 95° C. The degree of saponification attained was 99.2 mole %. This primary saponification reaction solution was then supplied in an up-flowing manner to the lower part of a shell and tube evaporator and the secondary saponification reaction of the second stage was carried out under the conditions of a pressure of 50 Torr and a temperature of 90° C. The final degree of saponification attained was 99.9 mole %. The reaction solution obtained by the saponification reaction was 1 weight % content of methanol and a PVA concentration of 20 weight %, and this solution could be used as it is as a spinning stock solution in a spinning process to produce fiber. The block character value of the PVA was 0.99.

Comparative Example 1

A stirring tank, equipped with a stirrer, was used as the saponification reactor, and a saponification reaction was carried out using the same paste as that used in Example 1. The mole ratio of methanol used was 9.0, degree of saponification of PVA obtained is 98.5 mole %, and though the degree of polymerization of PVA was 1720, the amount of DMSO used for prevention of gelling became high and the concentration of PVA in the reaction solution obtained was 5.5 wt %. The block character value of the PVA was 0.48.

Example 4

The PVA obtained in the first example was used as a spinning stock solution, and this spinning stock solution was discharged through a 400-hole nozzle into a coagulation bath of 5° C., comprised of 70 parts in weight of methanol and 30 parts in weight of DMSO, and thereby gelled. The DMSO was then extracted completely using methanol and the methanol was evaporated with hot air at a 150° C. temperature. The cross section of the thread that was obtained was substantially circular and hardly any Dernier spots could be seen. Upon drawing this thread in the two stages of 175° C. and 230° C. temperature by dry heat in a hollow heater, a high-strength PVA fiber with a single fiber strength of 12.1 cN (centinewtons)/dtex (decitex) and an elastic modulus of 291 cN/dtex was obtained at a total draw ratio of 16 times. 1 tex indicates that the mass of a fiber of 1000 m length is 1 g. The single fiber strength and elastic modulus were measured in compliance to the "Testing Methods for Chemical Fibers, Filaments, and Threads" of JIS L 1013.

What is claimed is:

1. A method of producing polyvinyl alcohol polymer comprising:

saponification of a polyvinyl ester in an alcohol-containing organic solvent under the presence of a saponification catalyst, wherein saponification is carried out with a mole ratio of alcohol with respect to polyvinyl alcohol of 1.0 to 3.0, while distilling off the carboxylic ester produced by the saponification reaction, wherein said saponification comprises:

a first stage saponification process, comprised in turn of a primary saponification reaction, in which a saponification reaction is carried out in a kneader mixer by mixing the polyvinyl ester in the alcohol-containing organic solvent under the presence of a saponification catalyst and a subsequent secondary saponification reaction, in which a saponification reaction is carried out in a tower reactor while distilling off the carboxylic ester that is produced; and a subsequent second stage saponification process, comprised in turn of a primary saponification reaction, in which a saponification reaction is carried out in a kneader mixer by mixing the polyvinyl ester in the alcohol-containing organic solvent under the presence of a saponification catalyst and a subsequent secondary saponification reaction, in which a saponification reaction is carried out in a shell and tube evaporator while distilling off the carboxylic ester that is produced, wherein the degree of saponification attained in said secondary saponification reaction of the second stage is 99.6 mole % or more and the concentration of the polyvinyl alcohol polymer in the saponification reaction solution is 10 wt % or more.

2. The method of claim 1, wherein the degree of saponification attained in said primary saponification reaction of the first stage is 70 mole % or more and the concentration of the polyvinyl alcohol polymer in the saponification reaction solution is 10 wt % or more.

3. The method of claim 1, wherein the degree of saponification attained in said secondary saponification reaction of the first stage is 85 mole % or more and the concentration of the polyvinyl alcohol polymer in the saponification reaction solution is 10 wt % or more.

4. The method of claim 1, wherein the degree of saponification attained in said primary saponification reaction of the second stage is 93 mole % or more and the concentration of the polyvinyl alcohol polymer in the saponification reaction solution is 10 wt % or more.

5. The method of claim 1, wherein said alcohol-containing organic solvent comprises at least one solvent selected from the group consisting of dimethyl sulfoxide, dimethylformamide, dimethylacetamide, N-methylpyrrolidone, ethylenediamine, and diethylenetriamine.

* * * * *